US010926275B1

(12) United States Patent
Kinne et al.

(10) Patent No.: US 10,926,275 B1
(45) Date of Patent: Feb. 23, 2021

(54) ELECTROSTATIC HANDHELD SPRAYER

(71) Applicant: Graco Minnesota Inc., Minneapolis, MN (US)

(72) Inventors: Robert W. Kinne, Columbia Heights, MN (US); Mark E. Ulrich, Oak Grove, MN (US); Diane L. Olson, Elk River, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 0 days.

(21) Appl. No.: 17/029,678

(22) Filed: Sep. 23, 2020

Related U.S. Application Data

(60) Provisional application No. 63/047,236, filed on Jul. 1, 2020, provisional application No. 63/044,333, filed on Jun. 25, 2020.

(51) Int. Cl.
*B05B 5/16* (2006.01)
*B05B 5/053* (2006.01)

(52) U.S. Cl.
CPC ..... *B05B 5/1691* (2013.01); *B05B 5/1675* (2013.01); *B05B 5/0533* (2013.01)

(58) Field of Classification Search
CPC ..... B05B 5/035; B05B 5/1675; B05B 5/1691; B05B 9/0413; B05B 9/0426; B05B 9/0861; B05B 5/053; B05B 5/0533
USPC ..... 239/3, 690, 708
See application file for complete search history.

(56) References Cited

U.S. PATENT DOCUMENTS

| | | | |
|---|---|---|---|
| 1,650,377 | A | 11/1927 | Nixon |
| 1,911,603 | A | 5/1933 | Breuer |
| 2,195,929 | A | 4/1940 | Klett |
| 2,405,006 | A | 7/1946 | Ashton |
| 2,407,792 | A | 9/1946 | McMillan |
| 2,488,789 | A | 11/1949 | Williams |
| 2,491,230 | A | 12/1949 | Theis |
| 2,540,357 | A | 2/1951 | Stanley |
| 2,629,539 | A | 2/1953 | Drewes, Jr. |
| 2,736,606 | A | 2/1956 | Kmiotek |
| 2,752,854 | A | 7/1956 | Prior et al. |
| 2,999,646 | A | 9/1961 | Wagner |
| 3,207,080 | A | 9/1965 | Schlosser |
| 3,250,225 | A | 5/1966 | Taplin |
| 3,276,389 | A | 10/1966 | Bower, Jr. |
| 3,317,141 | A | 5/1967 | Mann |
| 3,403,818 | A | 10/1968 | Enssle |
| 3,416,461 | A | 12/1968 | McFarland |
| 3,462,082 | A | 8/1969 | Everett |
| 3,633,828 | A | 1/1972 | Larson |

(Continued)

FOREIGN PATENT DOCUMENTS

| | | | |
|---|---|---|---|
| AU | 2019202483 | A1 | 5/2019 |
| CN | 2225310 | Y | 4/1996 |

(Continued)

*Primary Examiner* — Cody J Lieuwen
(74) *Attorney, Agent, or Firm* — Kinney & Lange, P. A.

(57) ABSTRACT

A fluid sprayer includes a pump and an electrostatic module configured to provide an electrostatic charge to spray fluid. The electrostatic module is electrically connected to a conductive component of the fluid sprayer, such as a fluid displacement member, fitting, cylinder, or spray tip, to charge the spray fluid via the conductive component. The fluid is electrostatically charged prior to exiting the fluid sprayer.

20 Claims, 11 Drawing Sheets

(56) References Cited

U.S. PATENT DOCUMENTS 3,658,257 A 4/1972 Rood
3,680,981 A 8/1972 Wagner
3,741,689 A 6/1973 Rupp
3,769,879 A 11/1973 Lofquist, Jr.
3,775,030 A 11/1973 Wanner
3,893,627 A 7/1975 Siczek et al.
3,916,449 A 11/1975 Davis
3,955,709 A 5/1976 Coley et al.
3,955,763 A 5/1976 Pyle et al.
3,993,250 A 11/1976 Shure
3,999,896 A 12/1976 Sebastiani
4,008,984 A 2/1977 Scholle
4,033,511 A 7/1977 Chamberlin
4,068,982 A 1/1978 Quarve
4,160,525 A 7/1979 Wagner
4,162,037 A 7/1979 Koyama
4,165,836 A 8/1979 Eull
4,235,377 A 11/1980 Davis et al.
4,294,408 A 10/1981 Snyder et al.
4,301,971 A 11/1981 Cornelius et al.
4,365,745 A 12/1982 Beck
4,386,739 A 6/1983 Kwok
4,403,924 A 9/1983 Gebauer et al.
4,442,977 A 4/1984 Beiswenger et al.
4,484,707 A 11/1984 Calder
4,548,363 A 10/1985 McDonough
4,549,467 A 10/1985 Wilden et al.
4,756,481 A 7/1988 Leuenberger
4,764,393 A 8/1988 Henger et al.
4,778,356 A 10/1988 Hicks
4,800,801 A 1/1989 van Zweeden
4,811,898 A 3/1989 Murphy
4,883,412 A 11/1989 Malizard et al.
4,902,206 A 2/1990 Nakazawa et al.
4,971,249 A 11/1990 Tam et al.
5,051,067 A 9/1991 Terauchi
5,054,947 A 10/1991 Frank et al.
5,066,199 A 11/1991 Reese et al.
5,092,750 A 3/1992 Leroy et al.
5,100,058 A 3/1992 Wei
5,106,274 A 4/1992 Holtzapple
5,137,431 A 8/1992 Kiyoshi et al.
5,145,339 A 9/1992 Lehrke et al.
5,150,841 A 9/1992 Silvenis et al.
5,165,869 A 11/1992 Reynolds
5,174,731 A 12/1992 Korver
5,211,611 A 5/1993 Lammers et al.
5,213,485 A 5/1993 Wilden
5,219,274 A 6/1993 Pawlowski et al.
5,222,664 A * 6/1993 Noakes ..... B05B 5/003 239/3
5,249,932 A 10/1993 Van Bork
5,271,537 A 12/1993 Johnson
5,340,029 A 8/1994 Adams
5,351,903 A 10/1994 Mazakas et al.
5,362,212 A 11/1994 Bowen et al.
5,378,122 A 1/1995 Duncan
5,391,058 A 2/1995 Goto et al.
5,443,211 A 8/1995 Young et al.
5,527,160 A 6/1996 Kozumplik, Jr. et al.
5,567,118 A 10/1996 Grgurich et al.
5,616,005 A 4/1997 Whitehead
5,649,809 A 7/1997 Stapelfeldt
5,699,967 A 12/1997 Conatser et al.
5,716,007 A 2/1998 Nottingham et al.
5,720,436 A 2/1998 Buschor
5,737,174 A * 4/1998 Konieczynski ..... B05B 5/1625 218/11
5,769,321 A 6/1998 Cyphers
5,816,778 A 10/1998 Elsey, Jr. et al.
5,839,612 A 11/1998 Burke
5,927,954 A 7/1999 Kennedy et al.
6,021,965 A * 2/2000 Hartle ..... B05B 5/1608 138/120
6,106,246 A 8/2000 Steck et al.
6,142,749 A 11/2000 Jack et al.
6,158,982 A 12/2000 Kennedy et al.
6,168,093 B1 1/2001 Greer, Jr. et al.
6,264,115 B1 7/2001 Liska et al.
6,280,149 B1 8/2001 Able et al.
6,299,415 B1 10/2001 Bahrton
6,364,622 B1 4/2002 Lishanski et al.
6,390,386 B2 5/2002 Krohn et al.
6,402,486 B1 6/2002 Steck et al.
6,488,180 B1 12/2002 Bayat
6,599,107 B2 7/2003 Cooper et al.
6,644,564 B2 11/2003 Perkitny
6,702,198 B2 3/2004 Tam et al.
6,708,900 B1 3/2004 Zhu et al.
D490,500 S 5/2004 Ye et al.
6,752,067 B1 6/2004 Davidson et al.
6,752,330 B2 6/2004 DiMaggio et al.
6,811,099 B2 11/2004 Krestine et al.
6,817,544 B2 11/2004 Hanson
6,933,634 B2 8/2005 Frank et al.
6,978,944 B1 12/2005 Carey et al.
7,018,181 B2 3/2006 Cooper et al.
7,025,087 B2 4/2006 Weinberger et al.
7,097,119 B2 8/2006 Hornsby et al.
7,182,280 B2 2/2007 Ye et al.
7,207,500 B2 4/2007 Hudson et al.
7,219,848 B2 5/2007 Sweeton
7,244,464 B2 7/2007 Robens et al.
7,255,294 B2 8/2007 Sweeton et al.
7,350,723 B2 4/2008 Reedy
7,354,255 B1 4/2008 Lishanski et al.
7,399,168 B1 7/2008 Eberwein
7,478,979 B2 1/2009 Zhou et al.
7,517,199 B2 4/2009 Reed et al.
7,600,985 B2 10/2009 Meloche et al.
7,654,801 B2 2/2010 Spude
7,658,598 B2 2/2010 Reed et al.
7,708,084 B2 5/2010 Duesselberg et al.
7,731,105 B2 6/2010 Lishanski et al.
7,758,321 B2 7/2010 Fukano et al.
7,770,701 B1 8/2010 Davis
8,123,500 B2 2/2012 Juterbock et al.
8,167,586 B2 5/2012 Towne
8,182,247 B2 5/2012 Gallwey et al.
8,292,600 B2 10/2012 Reed et al.
8,313,313 B2 11/2012 Juterbock et al.
8,382,445 B2 2/2013 Roseberry
8,393,881 B2 3/2013 Usui et al.
8,485,792 B2 7/2013 McCourt et al.
8,585,372 B2 11/2013 Bacher et al.
8,746,597 B2 6/2014 Sides
8,770,496 B2 7/2014 Altenburger
9,920,755 B2 3/2018 Afshari
10,322,424 B2 6/2019 Wright
10,589,298 B2 3/2020 Wright
2001/0035515 A1 11/2001 Kennedy et al.
2001/0038041 A1 11/2001 Leer et al.
2001/0048882 A1 12/2001 Layman
2002/0028103 A1 3/2002 Frank et al.
2002/0043576 A1 4/2002 Dion
2003/0173420 A1 9/2003 Hanson
2003/0178513 A1 9/2003 Lind et al.
2004/0057853 A1 3/2004 Ross et al.
2004/0069791 A1 4/2004 Neal
2004/0155118 A1 8/2004 Rice
2004/0217205 A1 11/2004 Kohs et al.
2004/0226969 A1 11/2004 Shew
2004/0251321 A1 12/2004 Ye et al.
2004/0256490 A1 12/2004 Sweeton
2005/0016448 A1 1/2005 Dilou
2005/0063131 A1 3/2005 Perkins
2005/0189445 A1 9/2005 Hartle et al.
2006/0040044 A1 2/2006 Robens et al.
2006/0076434 A1 4/2006 Hornsby et al.
2006/0086824 A1 4/2006 Pearce, III et al.
2006/0108981 A1 5/2006 Watson et al.
2006/0153707 A1 7/2006 Sweeton et al.
2006/0208005 A1 9/2006 Sweeton
2006/0257271 A1 11/2006 Juterbock et al.

(56) References Cited

U.S. PATENT DOCUMENTS

| | | | | |
|---|---|---|---|---|
| 2006/0291130 | A1* | 12/2006 | Hughes | B05B 5/047 361/220 |
| 2007/0025863 | A1 | 2/2007 | Liedtke et al. | |
| 2007/0092385 | A1 | 4/2007 | Petrie Pe | |
| 2007/0125878 | A1 | 6/2007 | Hahn et al. | |
| 2007/0129469 | A1 | 6/2007 | Befurt et al. | |
| 2007/0131109 | A1 | 6/2007 | Bruggeman et al. | |
| 2007/0134050 | A1 | 6/2007 | Bruggeman et al. | |
| 2007/0137938 | A1 | 6/2007 | Carpenter et al. | |
| 2007/0170285 | A1 | 7/2007 | Schouten | |
| 2007/0212241 | A1 | 9/2007 | Lishanski et al. | |
| 2007/0224358 | A1 | 9/2007 | Insausti-Eciolaza et al. | |
| 2007/0228186 | A1 | 10/2007 | Hornsby et al. | |
| 2007/0252019 | A1 | 11/2007 | Peterson et al. | |
| 2007/0261913 | A1 | 11/2007 | Rossner et al. | |
| 2007/0272707 | A1 | 11/2007 | Peralta et al. | |
| 2007/0278326 | A1 | 12/2007 | Wu | |
| 2007/0278787 | A1 | 12/2007 | Jones et al. | |
| 2008/0065001 | A1 | 3/2008 | DiNucci et al. | |
| 2008/0104780 | A1 | 5/2008 | Dayton et al. | |
| 2008/0173705 | A1 | 7/2008 | Girard et al. | |
| 2008/0178802 | A1 | 7/2008 | Sakakibara et al. | |
| 2009/0068036 | A1 | 3/2009 | Hsu et al. | |
| 2009/0145980 | A1 | 6/2009 | Jones | |
| 2009/0152382 | A1 | 6/2009 | Charpie | |
| 2009/0229517 | A1 | 9/2009 | Ko | |
| 2010/0045096 | A1 | 2/2010 | Schonlau et al. | |
| 2010/0072300 | A1 | 3/2010 | Miller et al. | |
| 2010/0196176 | A1 | 8/2010 | Kaufmann et al. | |
| 2010/0229792 | A1 | 9/2010 | Yamasaki et al. | |
| 2011/0198413 | A1 | 8/2011 | Thompson et al. | |
| 2012/0037726 | A1 | 2/2012 | Johnson et al. | |
| 2012/0063925 | A1 | 3/2012 | Parker | |
| 2012/0227389 | A1 | 9/2012 | Hinderks | |
| 2012/0243630 | A1 | 9/2012 | Golovins | |
| 2012/0298771 | A1 | 11/2012 | Johnson et al. | |
| 2013/0101445 | A1 | 4/2013 | Schutze | |
| 2013/0240641 | A1* | 9/2013 | Kinne | B05B 5/1691 239/289 |
| 2015/0226205 | A1 | 8/2015 | Hines et al. | |
| 2015/0226206 | A1 | 8/2015 | Hines et al. | |
| 2017/0291181 | A1 | 10/2017 | Wright | |
| 2018/0318857 | A1* | 11/2018 | Sato | B05D 1/04 |
| 2019/0060922 | A1 | 2/2019 | Wright | |
| 2019/0201927 | A1 | 7/2019 | Sides | |
| 2020/0121867 | A1 | 4/2020 | Wright | |

FOREIGN PATENT DOCUMENTS

| | | | |
|---|---|---|---|
| CN | 1185525 | A | 6/1998 |
| CN | 1974282 | A | 6/2007 |
| CN | 2912820 | Y | 6/2007 |
| CN | 101022891 | A | 8/2007 |
| CN | 101049587 | A | 10/2007 |
| CN | 101072644 | A | 11/2007 |
| CN | 200998701 | Y | 1/2008 |
| CN | 201101999 | Y | 8/2008 |
| CN | 101273198 | A | 9/2008 |
| CN | 101970125 | A | 2/2011 |
| CN | 102066710 | A | 5/2011 |
| DE | 2433841 | A1 | 2/1976 |
| DE | 10315483 | A1 | 11/2004 |
| EP | 0185311 | B1 | 12/1984 |
| EP | 0312862 | A2 | 4/1989 |
| EP | 0714709 | A1 | 6/1996 |
| EP | 0781922 | A1 | 7/1997 |
| EP | 1479448 | A2 | 11/2004 |
| EP | 1627689 | A1 | 2/2006 |
| EP | 2168686 | A2 | 3/2010 |
| FR | 2307983 | A1 | 11/1976 |
| GB | 1576075 | | 10/1980 |
| GB | 2302254 | A | 1/1997 |
| GR | 1005628 | B | 9/2007 |
| JP | S31010693 | A | 12/1956 |
| JP | S5138325 | A | 3/1976 |
| JP | S57131866 | U | 8/1982 |
| JP | S57200678 | A | 12/1982 |
| JP | S60178368 | A | 9/1985 |
| JP | S6183474 | U | 6/1986 |
| JP | S61255280 | A | 11/1986 |
| JP | S6259989 | B2 | 12/1987 |
| JP | S63100963 | A | 5/1988 |
| JP | S6421769 | U | 2/1989 |
| JP | H01148356 | A | 6/1989 |
| JP | H02500459 | A | 2/1990 |
| JP | H02196173 | A | 8/1990 |
| JP | 4346862 | A | 12/1992 |
| JP | 194997 | A | 8/1995 |
| JP | H09103714 | A | 4/1997 |
| JP | H10290942 | A | 11/1998 |
| JP | 2001506720 | A | 5/2001 |
| JP | 2004509742 | A | 4/2004 |
| JP | 2004261720 | A | 9/2004 |
| JP | 2005324089 | A | 11/2005 |
| JP | 2006082064 | A | 3/2006 |
| JP | 2007222787 | A | 9/2007 |
| JP | 2007330750 | A | 12/2007 |
| JP | 2008246404 | A | 10/2008 |
| JP | 2010279855 | A | 12/2010 |
| JP | 2012506316 | A | 3/2012 |
| KR | 1019970700134 | A | 1/1997 |
| KR | 102110089287 | A | 8/2011 |
| SU | 1623778 | A1 | 1/1991 |
| TW | 454575 | U | 9/2001 |
| WO | WO2007079932 | A1 | 7/2007 |
| WO | WO2011094246 | A1 | 8/2011 |
| WO | WO2017112781 | A1 | 6/2017 |

* cited by examiner

ELECTROSTATIC HANDHELD SPRAYER

CROSS-REFERENCE TO RELATED APPLICATION(S)

This application claims priority to U.S. Provisional Application No. 63/044,333 filed Jun. 25, 2020, and entitled "ELECTROSTATIC HANDHELD SANITARY SPRAYER," and claims priority to U.S. Provisional Application No. 63/047,236 filed Jul. 1, 2020, and entitled "ELECTROSTATIC HANDHELD SANITARY SPRAYER," the disclosures of which are hereby incorporated by reference in their entirety.

BACKGROUND

This disclosure generally relates to fluid sprayers. More particularly, this disclosure relates to electrostatic sprayers.

Sprayers apply fluid to a surface through a nozzle. Electrostatic spray guns are generally used to spray a coating, such as paint, onto a grounded object. Electrostatic spray guns typically pass an electrical charge through the gun and impart an electric charge to the fluid as the fluid exits the nozzle. The fluid is sprayed towards the grounded object by mechanical or compressed air spraying. The paint is drawn toward the grounded object due to the electrostatic charge.

SUMMARY

According to an aspect of the disclosure, a fluid sprayer includes a pump comprising at least one fluid displacement member configured to place fluid under pressure and an electrostatic module that supplies electrical energy to a conductive component that is exposed to the fluid within the pump to transfer electrostatic charge to the fluid.

According to an additional or alternative aspect of the disclosure, a portable fluid sprayer includes a sprayer body; a handle; a nozzle configured to emit a fluid spray; a trigger configured to control spraying from the nozzle; a reservoir configured to hold spray fluid; a pump supported by the sprayer body and configured to pump spray fluid from the reservoir to the nozzle; and an electrostatic module configured to provide electrical energy. The pump includes a pump body having a fluid inlet and a fluid outlet and a fluid displacement member at least partially disposed within the pump body and configured to move to pump the spray fluid from the fluid inlet to the fluid outlet under pressure for spraying from the nozzle. The fluid displacement member includes an electrically conductive material that moves during pumping. The electrostatic module is configured to provide electrical energy to the electrically conductive material of the fluid displacement member so that the fluid displacement member electrostatically charges the fluid as the fluid displacement member moves to pump the fluid to the nozzle.

According to another additional or alternative aspect of the disclosure, a portable fluid sprayer includes a sprayer body; a nozzle configured to emit a fluid spray; a trigger configured to control spraying from the nozzle; a pump including a piston configured to reciprocate to pump spray fluid to the nozzle; and an electrostatic module electrically connected to the piston to provide an electrostatic charge to the piston such that the piston can provide electrostatic energy to the spray fluid to charge the spray fluid. The piston includes an electrically conductive material that moves during pumping. The fluid sprayer is operable to spray fluid from the nozzle both in a first state, during which the electrostatic module provides the electrical energy to charge the spray fluid, and in a second state, during which the electrostatic module does not charge the spray fluid.

According to yet another additional or alternative aspect of the disclosure, a method of electrostatic spraying includes pumping a spray fluid with a moving fluid displacement member, the fluid displacement member comprising a material that is electrically conductive; generating an electrostatic charge with an electrostatic module; providing the electrostatic charge to the electrically conductive material of the fluid displacement member; charging the spray fluid with the electrically conductive material of the fluid displacement member while the electrically conductive material of the fluid displacement member moves to pump the fluid; and emitting electrostatically charged spray fluid from a nozzle of a sprayer due to pressure from the movement of the fluid displacement member.

DETAILED DESCRIPTION

Sprayers according to the present disclosure spray various materials, examples of which include paint, water, stains, finishes, solvents, and sanitary fluids, among other options. For example, the fluid sprayer can be used to spray fluids for disinfection, decontaminating, sanitizing, deodorizing, and other cleaning purposes. Typical sanitary fluid solutions contain chemical, solvent, or other components which are highly corrosive. The fluid solutions are typically of low viscosity and are readily atomized for spraying. The fluids are typically over 95% water.

The sprayer puts fluid under pressure to generate the fluid spray for application on a surface. In some examples, the sprayer is a handheld sprayer. An electrostatic charge is applied to the fluid at a location along the flowpath between a reservoir holding the fluid and a nozzle generating the fluid spray. The sprayer includes a fluid displacement member that puts the fluid under pressure. In some examples of the sprayer, the fluid displacement member can be the member that applies the electrostatic charge to the fluid.

Figure 1A:
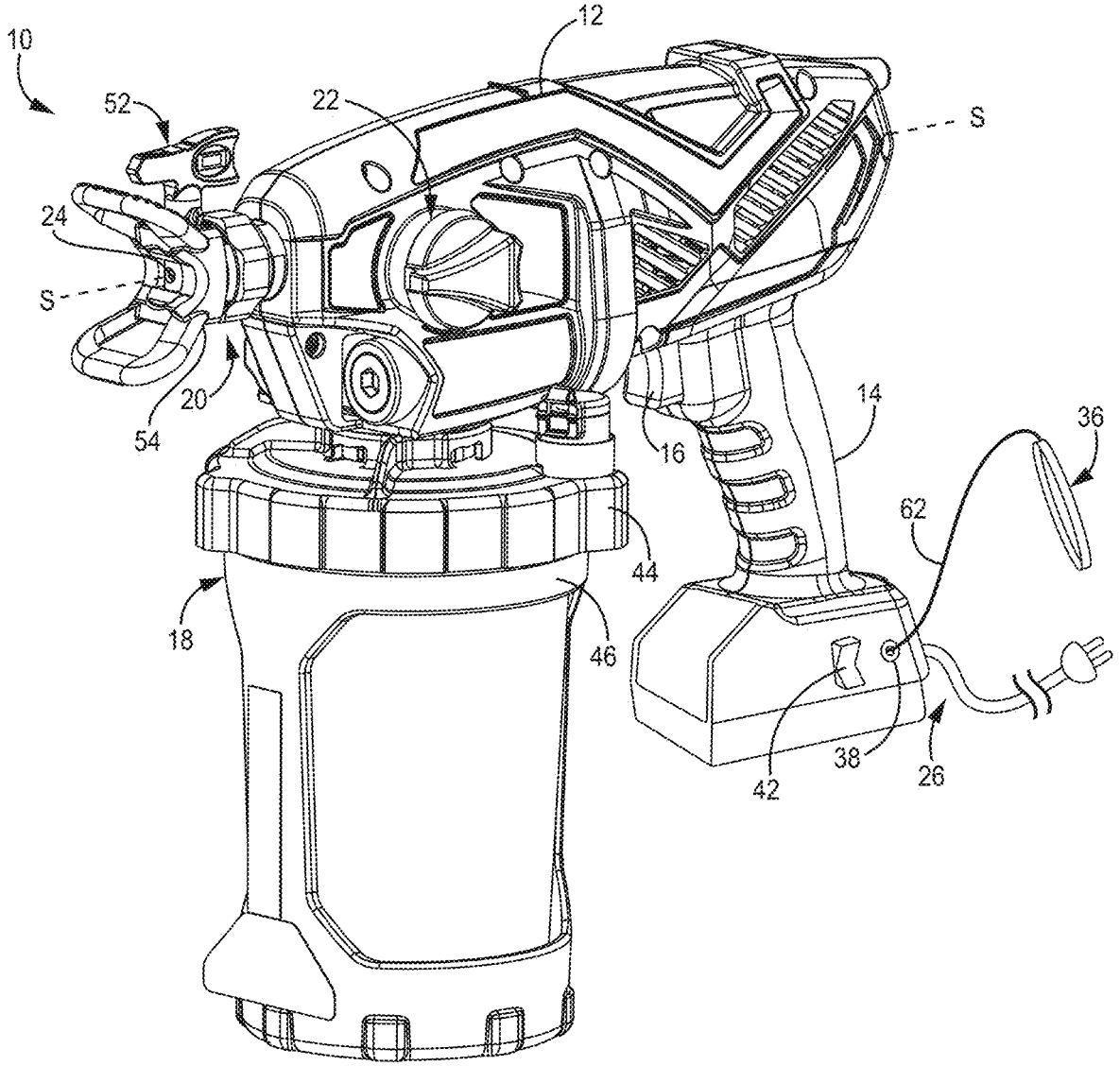
FIG. 1A is an isometric view of a sprayer.
Figure 1B:
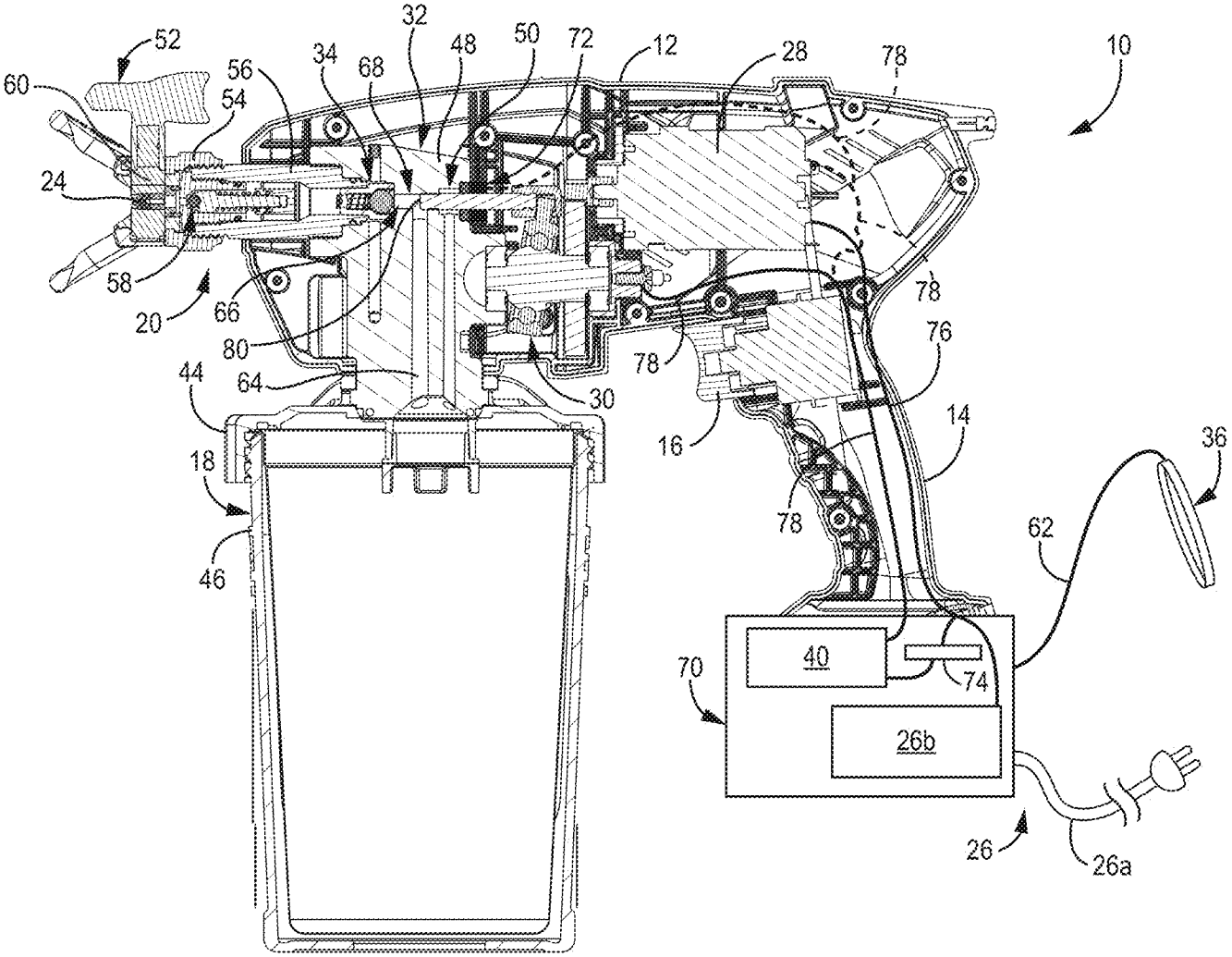
FIG. 1B is a cross-sectional view of a sprayer taken along line B-B in FIG. 1A.

FIG. 1A is a perspective view of sprayer 10. FIG. 1B is a cross-sectional view of sprayer 10 taken along line B-B in FIG. 1A. FIGS. 1A and 1B will be discussed together. Sprayer 10 includes housing 12, handle 14, trigger 16, reservoir 18, tip assembly 20, prime valve 22, nozzle 24, power source 26, motor 28, drive 30, pump 32, outlet check valve 34, ground 36, ground jack 38, electrostatic module 40, and electrostatic switch 42. Reservoir 18 includes lid 44 and reservoir body 46. Pump 32 includes pump body 48 and piston 50. Tip assembly 20 includes spray tip 52, tip holder 54, tube 56, and spray valve 58. Spray tip 52 includes tip cylinder 60. Ground 36 includes tether 62.

Housing 12 supports other components of sprayer 10. Housing 12 can be formed of any suitable material for supporting other components of sprayer 10. For example, housing 12 can be formed from a polymer or metal. In the example shown, housing 12 is a clamshell housing formed from two halves with a seam along a lateral center of housing 12. Handle 14 projects from a lower side of housing 12. A user can hold, support the full weight of, and operate sprayer 10 by grasping handle 14. Handle 14 extends relative housing 12 and can, in some examples, be formed by housing 12. The user can manipulate the position of sprayer 10 to apply the spray to a variety of surfaces and from a variety of angles.

Trigger 16 projects from housing 12 and is movable relative housing 12. In some examples, trigger 16 projects from handle 14. Trigger 16 can be actuated to control spraying by sprayer 10. For example, the user can grasp trigger 16 with fingers of the hand holding handle 14 and can pull trigger 16 rearwards towards handle 14 to initiate spraying by sprayer 10. Trigger 16 can then be released to stop spraying by sprayer 10.

Reservoir 18 is mounted to sprayer 10 and configured to store a supply of spray fluid. In some examples, reservoir 18 can include a flexible polymer container, such as a bag, within reservoir body 46 and within which the spray fluid is stored. Lid 44 connects to reservoir body 46 and can enclose the interior of reservoir 18. Lid 44 can secure the flexible container within reservoir 18 by capturing a portion of the container between lid 44 and reservoir body 46. In the example shown, reservoir 18 includes windows through which the user can grasp and squeeze the flexible polymer container to eliminate air and prime the pump 32. In some examples, reservoir body 46 can itself hold the fluid. In the example shown, the user can detach reservoir 18 from pump body 48 by rotating reservoir 18 relative pump body 48. Reservoir 18 can be filled with spray material and spraying resumed by reattaching reservoir 18 and actuating trigger 16. While reservoir 18 is shown as mounted to housing 12, it is understood that reservoir 18 can be remote from housing 12 and can provide fluid to sprayer 10 through a fluid line. For example, reservoir 18 can be a backpack connected to sprayer 10 by tubing, a separate reservoir held in a hand of the user, or a bucket storing the sanitary fluid, among other options.

In the example shown, reservoir 18 and handle 14 each project from the same side of housing 12 (e.g., both handle 14 and reservoir 18 are disposed below a spray axis S-S through nozzle 24). It is understood that, in some examples, handle 14 and reservoir 18 can be disposed on different sides of housing 12. In some examples, handle 14 and reservoir 18 can be disposed on opposite sides of housing 12 (e.g., one of handle 14 and reservoir 18 can extend from a top side of housing 12 and the other can extend from a bottom side of housing 12). Handle 14 and reservoir 18 can be disposed on opposite sides of a horizontal plane through the spray axis S-S.

Ground 36 is a portion of sprayer 10 configured to electrically ground sprayer 10. In some examples, ground 36 can be connected to the user to ground sprayer 10 through the user. In the example shown, ground 36 can be a bracelet tethered to sprayer 10. The bracelet is intended to be worn around the wrist of the user to electrically connect to the user as a ground. The ground 36 can contact and/or attach to other parts of the body or other objects. Ground 36 can be clip (e.g., alligator type clip) or other attachment mechanism. Ground 36 can be formed by a pad integrated into sprayer 10, such as at handle 14, and configured to be contacted by the hand grasping handle. Alternatively, the ground 36 can be weighted to drag on the floor surface, with an electrically conductive portion of the ground 36 contacting the floor surface. In some cases, ground 36 can plug-in to the $3^{rd}$ (i.e., ground) prong on any available AC power outlet or clamp to any earth ground, among other options. While sprayer 10 is described as including ground 36, it is understood that some examples of sprayer 10 may not include a ground 36, such as where electrostatic module 40 does not require grounding to operate.

Ground 36 can be connected to sprayer 10 by tether 62 that is removably connected to sprayer 10 at ground jack 38. In the example shown, ground jack 38 is formed in removable housing 70. It is understood, however, that ground jack 38 can be formed at any desired location on sprayer 10 suitable for electrically connecting to ground electrostatic module 40. For example, ground jack 38 can be formed in handle 14 or elsewhere on housing 12. Ground jack 38 facilitates mounting and removal of ground 36 from sprayer 10. Ground 36 can be disconnected from sprayer 10 with sprayer operating in a passive mode, as discussed in more detail below. Ground jack 38 also facilitates mounting of different types of ground 36 to sprayer 10, which provides modularity to allow the user to utilize whichever type of ground 36 is desired.

Motor 28 is disposed within and supported by housing 12. Motor 28 can be electrically powered. Motor 28 is configured to power reciprocation of piston 50. For example, motor 28 can be an electric rotary motor (e.g., a brushless DC, or AC induction, motor). In the example shown, the motor 28 outputs rotational motion to drive 30. The drive 30 converts rotational motion output from the motor 28 to linear reciprocating motion that drives the pump 32. In the particular embodiment, the drive 30 is a wobble-type drive, though it is understood that drive 30 can be of any configuration suitable for converting the rotational output of motor 28 into a linear reciprocating input to piston 50.

It is understood that motor 28 can be a solenoid that outputs reciprocating motion. In this case, drive 30 would not be necessary. Coil windings surrounding a piece formed from ferromagnetic material could be energized to repel or attract the ferromagnetic material to linearly move the piece formed from ferromagnetic material. The piece formed from ferromagnetic material can be attached to the piston 50.

Power source 26 provides power to sprayer 10 to cause spraying by sprayer 10. Power source 26 can be a cord **26*a* that can be plugged into a suitable outlet, such as a wall socket. Additionally or alternatively, sprayer 10 can include a battery 26*b* mounted to sprayer 10 for providing electric power to sprayer 10. For example, the battery 26*b* can be mounted to a bottom of handle 14, among other mounting options. Power source 26 is configured to power motor 28 and electrostatic module 40**.

Electrostatic module 40 is shown as part of the fluid sprayer 10. Electrostatic module 40 is supported by housing 12. The electrostatic module 40 can be located within the housing 12. In some examples, electrostatic module 40 can be disposed in a removable housing 70 that is removably mountable to handle 14. The removable housing 70 can house both the battery **26*b* and electrostatic module 40**.

The electrostatic module 40 can be supplied with electrical power from the power source 26. For example, a motor lead 76 can extend to motor 28 from power source to provide power to motor 28. The motor lead 76 can be electrically connected to a control board 74 that that converts the voltage from the motor lead 76. For example, the control board 74 can reduce the incoming voltage. The control board 74 can output direct current to the electrostatic module 40. The electrostatic module 40 can thereby receive a lower voltage than is normally output by power source 26. The electrostatic module 40 can receive a lower voltage than that that powers motor 28. The electrostatic module 40 converts the incoming power to a high voltage. In some examples, the signal provided to electrostatic module 40 can be about 5V. The high voltage is provided through charge lead 78 to a component within housing 12 to electrostatically charge the fluid, as discussed in more detail below. The charge lead 78 can attach to various parts of the fluid sprayer 10. For example, the charge lead 78 can be connected to motor 28, drive 30, or a component contacting piston 50, among other options.

Electrostatic module 40 supplies electrical power to electrostatically charge the fluid being pumped through and sprayed from the fluid sprayer 10. Electrostatic module 40 can output a direct current signal in the range of 5-10 kV, preferably between 7 and 10 kV, although higher and lower voltages are possible. Electrostatic module 40 can output a direct current signal in a range of 5-50 μA, although higher and lower amperage is possible.

Sprayer 10 is operable between an active mode and a passive mode. Electrostatic module 40 is activated to provide an electrostatic charge with sprayer 10 in the active mode. Electrostatic module 40 is deactivated such that electrostatic module 40 does not provide the charge when sprayer 10 is in the passive mode. Ground jack 38 facilitates connecting ground 36 to sprayer 10 to operate sprayer 10 in the active mode. Ground jack 38 facilitates removal of ground 36 from sprayer 10 when operating in the passive mode.

Electrostatic switch 42 is formed on sprayer 10. For example, electrostatic switch 42 can extend through and/or be mounted to housing 12 and/or removable housing 70. Electrostatic switch 42 allows the user to control the operating mode of sprayer 10 between the active mode and the passive mode. The user can actuate switch between an on state and an off state. In the on state, the electrostatic module 40 is activated to provide a charge to the spray material. In the off state, the electrostatic module 40 is deactivated and does not provide a charge to the spray material. As such, sprayer 10 can be operated as both an electrostatic sprayer and a standard sprayer without electrostatic charging. Electrostatic switch 42 can be of any desired configuration, such as a toggle, flip, dial, knob, etc.

In some examples, sprayer 10 is an airless sprayer which means that sprayer 10 does not utilize airflow to propel the spray fluid. Instead, the pressures generated by pump 32 cause the atomization and spraying. It is understood that, in some examples, sprayer 10 can include air to atomize, shape, and/or guide the spray fluid. In some examples, motor 28 can drive rotation of a turbine to generate a flow of air to atomize the fluid for spraying through nozzle 24. While sprayer 10 is discussed in connection spraying a sanitary fluid, any sprayer referenced herein can spray fluid, not just sanitary fluid.

Prime valve 22 is supported by pump 32. Prime valve 22 is placed in a prime position to prime pump 32 before initiating spraying. Prime valve 22 is actuated to a spray position during spraying. Prime valve 22 circulates fluid to reservoir 18 when in the prime position and closes that flowpath so the fluid instead flows out nozzle 24 when in the spray position.

Pump 32 is partially or fully contained within a pump body 48 which itself is part of the pump 32. Pump body 48 is supported by housing 12. The pump body 48 can be a block of polymer that encases one or more parts of the pump 32 and also structurally supports the pump 32. The pump body 48 can be formed from a single piece of injected polymer material. The polymer material can be nylon, such as glass filled nylon (polyamide). The polymer may alternatively be acetal homopolymer.

The pump body 48 defines multiple fluid pathways. The fluid pathways can be formed during the injection molding process of the pump body 48 and/or can be machined from the polymer block after molding. One fluid pathway is the fluid intake 64. The fluid intake 64 provides a pathway for spray material to be drawn from the reservoir 18 up to a pump chamber 66 that is at least partially defined by inner cylinder 68. In the example shown, inner cylinder 68 is formed from the polymer material of pump body 48. Pump body 48 and inner cylinder 68 are formed by polymer and therefore insulative and non-conductive with respect to the electrostatic charge.

Piston 50 is driven by motor 28 and drive 30 to place the spray material under pressure and drive the spray material through nozzle 24. Piston 50 is a fluid displacement member of sprayer 10. Piston 50 reciprocates within pump body 48. More specifically, the piston 50 reciprocates within inner cylinder 68. The exterior of piston 50 can directly contact portions of the pump body 48 defining the pump chamber 66 during reciprocation of piston 50. Relative movement between the interfacing surfaces of piston 50 and pump body 48 form dynamic seals that facilitate generation of sufficient spray pressure to atomize the fluid into a desirable spray pattern.

The piston 50 is linearly reciprocated by the drive 30 through a suction stroke and a pressure stroke. A pump cycle is defined by subsequent suction and pressure strokes. The drive 30 displaces piston 50 in first axial direction AD1 through the pressure stroke (forward direction) and in second axial direction AD2 through the suction stroke (backward direction). Piston 50 is cylindrical. The piston 50 can be formed from metal. For example, the piston 50 can be formed from stainless steel or titanium, among other options. In some examples, the cylindrical exterior of the piston directly contacts the cylindrical interior of the inner cylinder 68 and the surfaces slide relative to each other during the pressure and suction strokes. The interface of these surfaces seals to prevent the spray fluid from leaking out backward past the piston 50.

In various alternative embodiments, and as discussed in more detail below with regard to FIG. 3C, the pump chamber 66 is at least partially defined by a tube embedded within the pump body 48. The tube can be formed from metal and can define the interior wall of the pump chamber 66, the metal interfacing with the exterior of the piston. In some versions, the tube can be connected to the electrostatic module 40 such that the tube transfers a charge to the fluid been pumped within the pump chamber 66. The tube can be formed from brass, titanium, stainless steel, or other electrically conductive metal.

Outlet check valve 34 is disposed in and supported by pump housing 12. Outlet check valve 34 supports pumping by closing to prevent material already expelled from the pump chamber 66 from flowing back into the pump chamber 66 during the suction stroke. The outlet check valve 34 opens during the pressure stroke due to pressure generated by piston 50 to permit pumped fluid to flow from pump chamber 66 out through nozzle 24. Outlet check valve 34 can be of any desired configuration suitable for facilitating one-way flow downstream from pump chamber 66.

Tip assembly 20 is supported by pump body 48. For example, tip assembly 20 can be mounted to pump body 48. Tube 56 interfaces with pump body 48 to connect tip assembly 20 to pump body 48. For example, tube 56 and pump body 48 can be joined by interfaced threading formed on tube 56 and pump body 48, among other options. Tube 56 can interface with outlet check valve 34 to retain outlet check valve 34 in pump body 48. Tube 56 can be formed from a polymer and includes an internal pathway. Tube 56 connects to the pump body 48 on one end and connects (e.g., threads) with a tip holder 54 on the other end. Spray valve 58 is supported by tip assembly 20. In some examples, spray valve 58 includes a spring-biased needle that opens to release spray fluid from the nozzle 24 when the pressure developed by pump 32 reaches a threshold amount, overcoming the force exerted by the spring. It is understood that other spray valve 58 designs and methods of operation are possible.

Spray tip 52 is mounted to sprayer 10. In the example shown, spray tip 52 is supported by tip assembly 20. Nozzle 24 is formed as a part of spray tip 52 and is configured to generate the spray. Spray tip 52 is removable and can be replaced. Spray tip 52 is disposed within a bore formed in tip holder 54 that is mounted to tube 56. Tip holder 54 can be a polymer or metal housing. Spray tip 52 includes tip cylinder 60 that is disposed within the bore of tip holder 54. Tip cylinder 60 can be formed from metal. Nozzle 24 can likewise be formed from metal. In some examples, nozzle 24 can be formed from tungsten carbide.

Spray tip 52 can be rotated between a spray position and a de-clog position. Nozzle 24 is typically the narrowest portion of the fluid path through sprayer 10 and is thus the likeliest location for clogs to form. The spray tip 52 is positioned to generate and eject an atomized fluid spray through nozzle 24 when in the spray position. Spray tip 52 is reversed to eject any clogs or clumped fluid from spray tip 52 when in the de-clog position. For example, the spray tip 52 can be rotated 180-degrees between the spray position and the de-clog position. In the spray position, the outlet of nozzle 24 is oriented out of sprayer 10. In the de-clog position, the inlet of nozzle 24 is oriented out of sprayer 10. Nozzle 24 can be configured to generate any desired spray pattern when in the spray position, such as a fan or cone, among other options. Spray tip 52 can be replaced with a spray tip 52 having a different nozzle 24 configuration to change the spray pattern.

Pump 32 generates the spray by driving the material through nozzle 24 under pressure. In some examples, sprayer 10 includes a pressure control switch that allows the user to set an operating pressure of pump 32. For example, the control switch can be a dial that indicates the actual pressure of each setting or a range between a minimum and maximum, among other options. In some examples, a maximum spray pressure of a sanitary fluid sprayer 10 can be set in the control such that the controller will not operate the motor 28 to drive the output fluid pressure above the maximum pressure. For example, the maximum pressure can be set at about 6.89 megapascal (MPa) (about 1000 pounds per square inch (psi)) or set below 6.89 MPa (1000 psi). In such examples, the user can set the output pressure in a range up to the maximum pressure at 6.89 MPa (1000 psi), but not above the maximum pressure. In some embodiments, the maximum pressure may be equal to or less than 6.89 MPa (1000 psi), equal to or less than 5.52 MPa (800 psi), equal to or less than 4.14 MPa (600 psi), equal to or less than 2.76 MPa (400 psi), or equal to or less than 1.38 MPa (200 psi). In some cases, the maximum pressure may be equal to or greater than 6.89 MPa (1000 psi), such as up to about 10.34 MPa (1500 psi).

During operation, the user can grasp handle 14 to maneuver and orient sprayer 10 to apply sprays of fluid onto surfaces. The user actuates trigger 16 to cause power source 26 to power motor 28. Motor 28 proves a rotational output to drive 30 and drive 30 causes reciprocation of piston 50. Piston 50 moves forward through inner cylinder 68 to decrease the volume of and increase the pressure in pump chamber 66 and thereby drive spray material through outlet check valve 34 to nozzle 24. Piston 50 moves rearward through inner cylinder 68 to increase the volume of pump chamber 66 and cause reduced pressure to form in pump chamber 66. The negative pressure draws spray material into pump chamber 66 from reservoir 18. The reciprocation of piston 50 draws spray fluid into pump chamber 66 from reservoir 18 and drives the spray fluid downstream from pump chamber 66 through outlet check valve 34, spray valve 58, and nozzle 24.

Electrostatic module 40 also receives power from power source 26. Electrostatic module 40 generates the charge and provides the charge via charge lead 78. In the example shown, the charge is provided to the piston 50 to electrostatically charge the fluid. The piston 50 can be the only component of sprayer 10 configured to provide charge to the fluid. In some examples, electrostatic module 40 can be indirectly electrically connected to piston 50 by intermediate components of sprayer 10. For example, the charge lead 78 can be connected to motor 28 and the charge can travel through motor 28 and drive 30 to piston 50. In some examples, the charge lead 78 can be connected to drive 30 and the charge can travel through drive 30 to piston 50. In some examples, the charge lead 78 can be connected to piston 50 to provide the charge directly to piston 50. For example, sliding contact 72 can be disposed around the piston to provide the charge to the piston. By way of example, charge lead 78 is shown as extending to drive 30, and alternatively (in dashed lines) to motor 28 and sliding contact 72. It is understood that charge lead 78 need extend to only one location to provide the electrostatic charge. The electrostatic energy can be indirectly provided to the piston 50 while the electrically conductive material of the piston directly charges the fluid.

The piston 50 directly contacts the fluid being sprayed during reciprocation of piston 50. The piston 50 is thereby the component that directly imparts the electrostatic charge to the material being sprayed. As such, in the example shown, the material in the reservoir 18 is not directly charged. There is no electrode without or near the reservoir 18 that charges the material. The material is not charged upstream of pump 32. The material becomes charged only to the extent the material is pulled into the pump chamber 66 and comes in contact with the piston face 80 of piston 50 and becomes charged. The piston 50 can be the only component of pump 32 that directly charges the fluid. The fluid exiting the pump chamber 66 through the outlet check valve 34 is thus charged as it travels through the tip assembly 20 and out nozzle 24. The charge is applied within sprayer 10 at a location upstream of nozzle 24. The charge can be a negative charge.

In the example shown, sprayer 10 does not include a standalone electrode along the fluid path to convey electrostatic charge to the fluid, either upstream of the pump 32 or downstream of the pump 32. In the example shown, the piston 50 is the only component that transfers any or a substantial amount of electrostatic energy from the electrostatic module 40 to the fluid. The electrostatic energy is provided to the fluid by a component directly contacting the fluid. The electrostatic energy is provided by a component of sprayer 10 that performs another function within sprayer 10. In the example shown, that other component is the piston 50, which also pressurizes and pumps the fluid.

In some examples, the electrostatic charge can be applied to the spray material by other components of sprayer 10 disposed downstream of reservoir 18 and upstream of nozzle 24. For example, the pump housing 12 can include conductive components that transfer the electrostatic charge to the fluid. In some examples, reversible spray tip 52 is electrically connected to the electrostatic module 40 to receive charge from electrostatic module 40 and deliver electrostatic charge to the fluid. For example, charge lead 78 can extend to and contact spray tip 52. In the illustrated example, reversible spray tip 52 is electrically insulated from the electrostatic module 40 by the tube 56, except due to contact with the fluid. The tube 56 can be polymer, as can be the pump body 48, so as to not readily convey electrostatic energy from the electrostatic module 40 to the fluid by those components.

Electrostatically charged atomized fluid that is released from the nozzle 24 is attracted to objects, particularly metallic grounded objects. Electrostatically charged atomized fluid will veer towards objects while it drifts and falls to better coat the objects, such as the far and/or undersides of the objects relative to the nozzle 24. In some cases, electrostatically charged atomized fluid can more efficiently cover an object by spraying less volume of fluid for equivalent coverage relative to non-electrostatically charged atomized fluid.

The user can deactivate electrostatic module 40 to convert sprayer 10 to a sprayer that does not electrostatically charge the spray. The user can actuate electrostatic switch 42 from the activated position to the deactivated position to deactivate electrostatic module 40. Sprayer 10 can thereby be placed in the passive mode. Ground 36 can be removed. For example, tether 62 can be unplugged from ground jack 38. The user can spray uncharged fluid by depressing trigger 16 to activate motor 28 and drive reciprocation of piston 50.

Pump 32 operates in the same manner with sprayer 10 in each of the activated state and the passive state. In the passive state, piston 50 is reciprocated to pump fluid from reservoir 18 to nozzle 24 to generate the spray; however, electrostatic module 40 is deactivated such that neither piston 50 nor other components of sprayer 10 provide a charge to the fluid from electrostatic module 40. The difference between the active state and the passive state is whether electrostatic module 40 is generating the charge to charge the fluid. Sprayer 10 can provide either a charged fluid spray or an uncharged fluid spray, depending on the operating mode.

Sprayer 10 provides significant advantages. Sprayer 10 facilitates electrostatic spraying by a handheld sprayer that can fully support the charging components of the sprayer. Sprayer 10 can directly support reservoir 18 such that both the fluid holding component and the electrostatic charging component are directly supported by sprayer 10. Handheld sprayer 10 simplifies and improves the efficiency of the electrostatic spraying process. Electrostatic module 40 is supported by housing 12 and moves with sprayer 10. As such, sprayer 10 does not require wires to extend to the sprayer 10. Removing the external wires simplifies the electrostatic spray process and removes a potential trip hazard. In addition, removing the external wires facilitates electrostatic spraying at locations where such spraying was infeasible.

The electrostatic charge is applied to the spray material at a location between reservoir 18 and nozzle 24. The electrostatic charge is applied to the material within the flowpath between reservoir 18 and nozzle 24. The electrostatic charge is applied by another component of sprayer 10. The charging component (e.g., piston 50, spray tip 52, etc.) has a dual function in that the charging component both charges the material and performs another function for sprayer 10. For example, piston 50 can both charge the fluid and place the fluid under pressure. Spray tip 52 can both charge the fluid and support nozzle 24 for atomizing the fluid and generating the spray. The charging component performing multiple functions simplifies construction of sprayer 10 by removing extra electrodes and electrical components previously required to provide the charge. Charging the fluid internally further eliminates external electrodes that are susceptible to contact damage. As such, sprayer 10 provides a robust, compact electrostatic sprayer.

Sprayer 10 further provides a hybrid sprayer that the user can selectively use to apply a charged spray or an uncharged spray. The user can selectively activate and deactivate electrostatic module 40. This allows the user to employ electrostatics when doing so will increase the efficiency of spraying. The user can deactivate the electrostatics for other applications, such as where the substrate is not positively grounded or in environments not suitable for electrostatic spraying. Deactivating the electrostatics can also reduce power consumption. The hybrid nature of sprayer 10 thereby allows sprayer 10 to be used in a variety of environments and applications. In addition, a user can perform both electrostatic spraying and non-electrostatic spraying with a single sprayer 10, saving costs. Ground jack 38 also allows for ground 36 to be removed from sprayer 10 when operating in the passive mode. Removing the ground 36 when not performing electrostatic spraying provides for a user friendly, comfortable spray process.

Figure 2A:
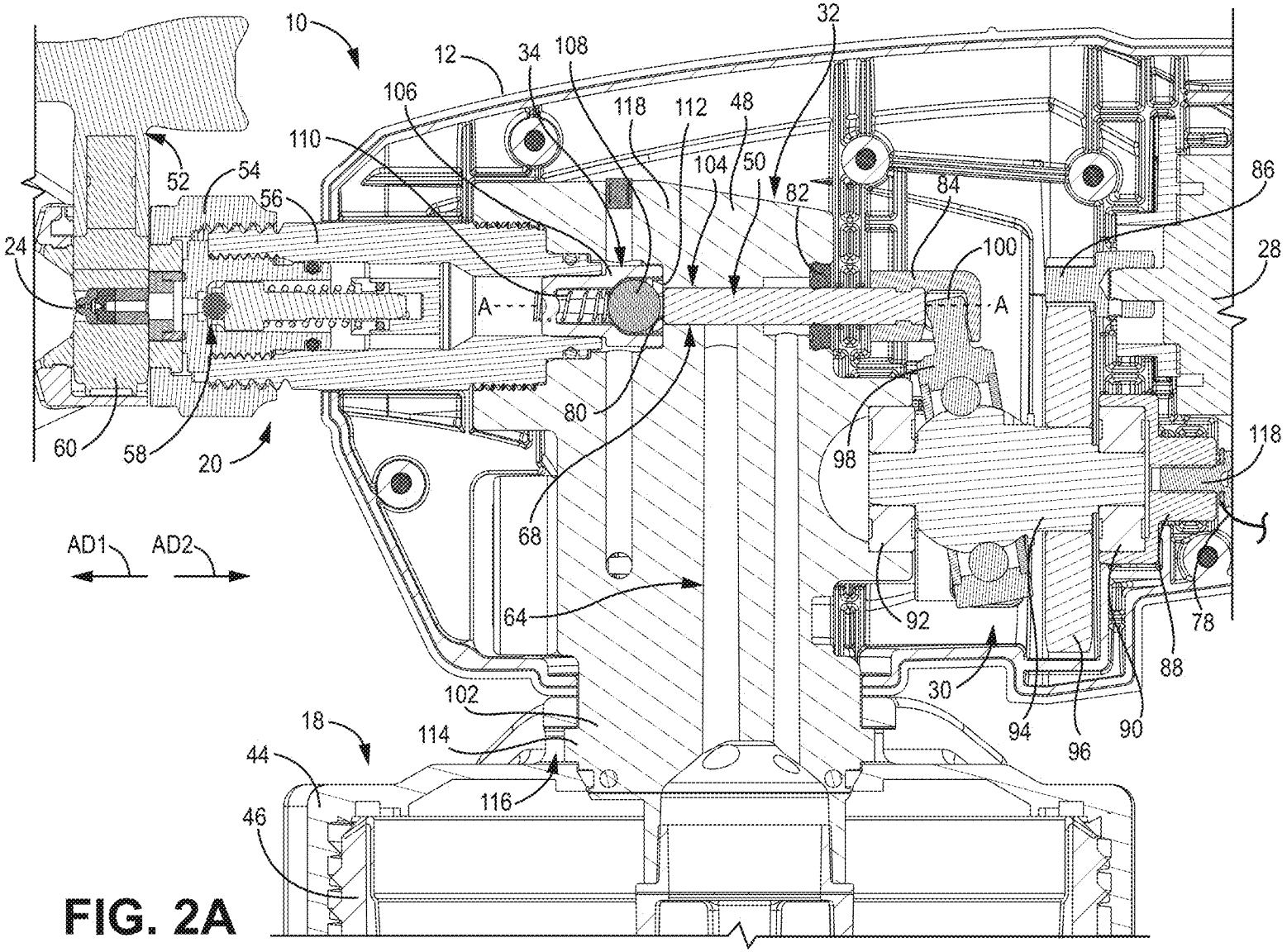
FIG. 2A is an enlarged view of detail 2 in FIG. 1B with the pump at the end of a pressure stroke.
Figure 2B:
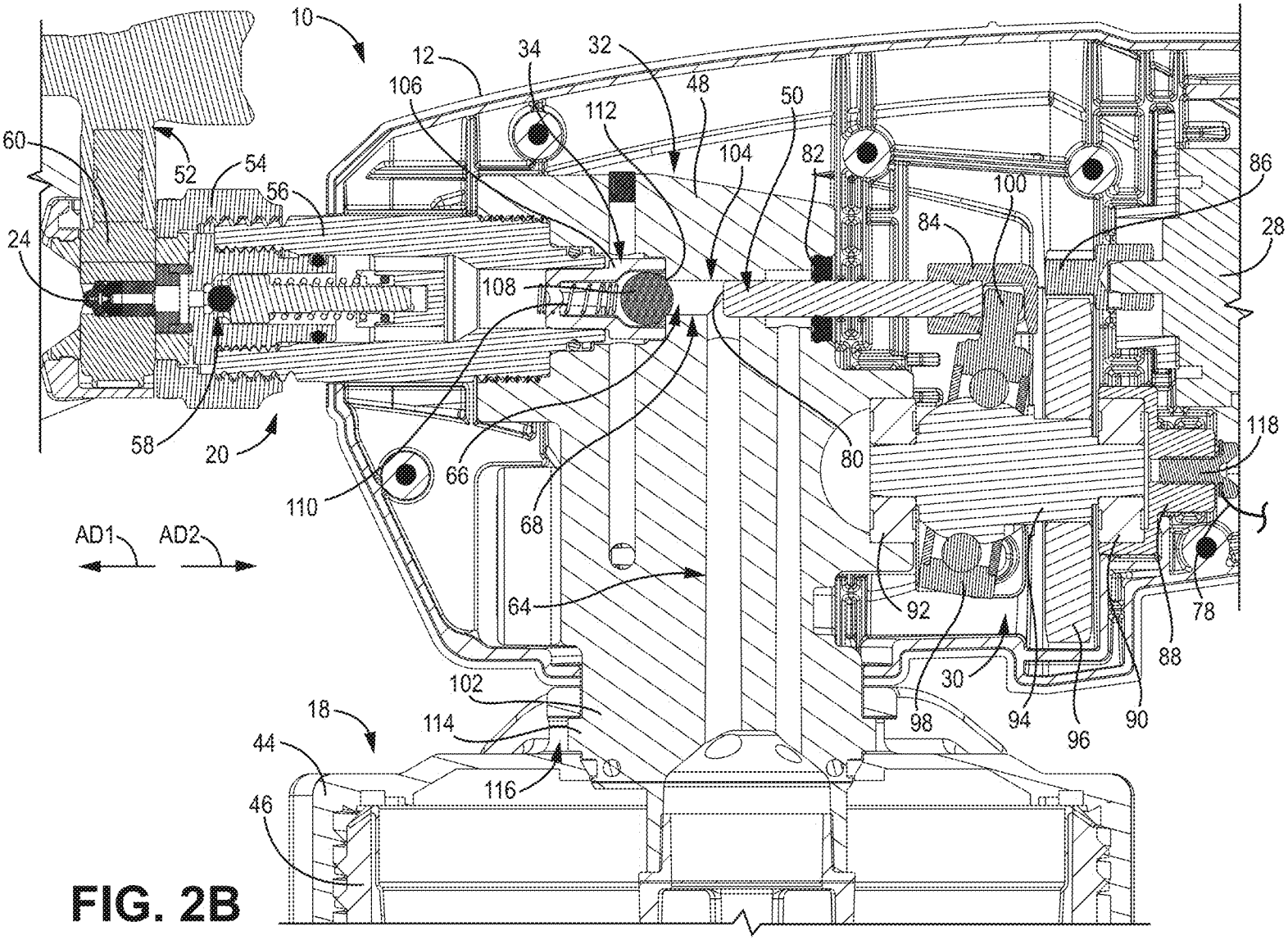
FIG. 2B is an enlarged view of detail 2 in FIG. 1B with the pump at the end of a suction stroke.

FIG. 2A is an enlarged cross-sectional view showing piston 50 at the end of a pressure stroke. FIG. 2B is a cross-sectional view similar to FIG. 2A but showing the piston 50 at the end of a suction stroke. FIGS. 2A and 2B will be discussed together. Housing 12, reservoir 18, tip assembly 20, nozzle 24, motor 28, drive 30, pump 32, outlet check valve 34, throat seal 82, and coupler 84 of sprayer 10 are shown. Reservoir 18 includes lid 44 and reservoir body 46. Motor 28 includes pinion 86. Drive 30 includes cap 88, rear bearing 90, front bearing 92, shaft 94, gear 96, and collar 98. Collar 98 includes projection 100. Pump 32 includes pump body 48 and piston 50. Neck 102 and pump bore 104 of pump body 48 are shown. Piston 50 includes piston face 80. Tip assembly 20 includes spray tip 52, tip holder 54, tube 56, and spray valve 58. Outlet check valve 34 includes cage 106, valve member 108, spring 110, and seat 112.

Pump 32 is at least partially disposed within housing 12 and is configured to draw spray fluid from reservoir 18 and drive the spray fluid through nozzle 24 for spraying. Pump 32 includes piston 50 configured to put the sanitary fluid under pressure to generate the atomized fluid spray. While pump 32 is discussed in connection spraying a sanitary fluid, pump 32 can spray fluid, not just sanitary fluid. Pump body 48 supports other components of pump 32. Pump body 48 is at least partially disposed in sprayer housing 12. In the example shown, pump body 48 extends out a lower side of housing 12. Neck 102 extends through a lower side of housing 12. Reservoir 18 can fluidly connect to pump 32 at neck 102. In some examples, reservoir 18 can directly interface with neck 102 to mount reservoir 18 to sprayer 10. For example, slots formed in one of lid 44 and neck 102 can interface with projections formed in the other one of lid 44 and neck 102. In the example shown, mounting projections 114 extend from neck 102 and slots 116 are formed in lid 44. Neck 102 can thereby be considered to form a mounting portion of pump body 48 for reservoir 18 to mount at.

Fluid intake 64 extends into pump body 48 and is at least partially formed through neck 102. Fluid intake 64 is configured to receive spray fluid from reservoir 18. Pump bore 104 is formed in pump body 48. Pump bore 104 can include multiple coaxial bores of differing diameters. Fluid intake 64 extends to and intersects with pump bore 104. Inner cylinder 68 is formed as a part of pump bore 104. Inner cylinder 68 can be formed directly by the polymer pump body 48. Pump chamber 66 is disposed on a downstream side of the intersection between fluid intake 64 and pump bore 104 and, in the example shown, is at least partially defined by the portion of polymer pump body 48 forming inner cylinder 68. Pump chamber 66 is further defined between piston face 80 and outlet check valve 34. The volume of pump chamber 66 varies between a minimum volume at an end of the pressure stroke (FIG. 2A) and a maximum volume when piston 50 passes over pump intersection 62 and opens a flowpath into pump chamber 66 (FIG. 2B).

Throat seal 82 is supported by pump body 48. Throat seal 82 is disposed annularly around piston 50. Throat seal 82 is disposed within pump bore 104 and at an opposite end of pump bore 104 from outlet check valve 34. Piston 50 extends through throat seal 82 and interfaces with throat seal 82. Throat seal 82 can be formed from rubber or other flexible material that dynamically seals with piston 50 as piston 50 reciprocates.

Piston 50 reciprocates within pump body 48 to vary a size of pump chamber 66 and pump the spray fluid. The piston 50 is linearly reciprocated by the drive 30 through its suction stroke (second axial direction AD2) and pressure stroke (first axial direction AD1). Piston 50 is cylindrical. Piston 50 can be formed from an electrically conductive material. For example, the piston 50 can be formed from metal. In some examples, the piston 50 is formed from stainless steel or titanium, among other options.

Piston 50 extends from drive 30 to reciprocate within pump bore 104. Piston 50 can be cantilevered from drive 30. Drive 30 is supported by housing 12. Cap 88 at least partially houses rear bearing 90. Rear bearing 90 supports shaft 94. Shaft 35 is also supported by front bearing 92. Front bearing 92 is supported by pump housing 12. Shaft 94 is annularly surrounded by gear 96. Collar 98 is eccentrically mounted on shaft 94. Projection 100 extends from collar 98. Gear 96 includes outer teeth which interface with the outer teeth of the pinion 86 extending from motor 28.

Motor 28 outputs rotational motion via the pinion 86, which rotational motion in turn rotates the gear 96. Rotation of the gear 96 rotates shaft 94. The eccentric mounting of collar 98 on shaft 94 causes collar 98 to wobble back and forth as shaft 94 rotates. Collar 98 can also be referred to as a wobble or swash plate. The wobbling of collar 98 cause projections 100 to move in a reciprocating manner to drive piston 50 back and forth such that piston 50 reciprocates linearly on piston axis A-A. The axis of reciprocation A-A of piston 50 can be coaxial with spray axis S-S. Piston 50 is connected to drive 30 by projection 100. The projection 100 moves back and forth as the collar 98 wobbles. The projection 100 is captured in a socket of coupler 84. The coupler 84 surrounds the rear end of piston 50 to move the piston back and forth with the motion of projection 100. Projection 100 can directly contact the rear end of the piston 50.

Charge lead 78 extending from electrostatic module 40 (FIG. 1B) can be connected to drive 30 to provide a charge to piston 50. For example, charge lead 78 can terminate in an eyelet disposed around fastener 118. Fastener 118 is connected to cap 88. For example, fastener 118 can include threading configured to interface with cap 88 to connect fastener 118 to cap 88. In some examples, fastener 118 is a screw.

While a single piston 50 is shown here, multiple pistons 50 can be used. Likewise, there is a corresponding number (e.g., multiple) of pumping chambers and cylinders formed from the same pump body 48. For example, drive 30 can reciprocate out of phase two pistons, three pistons, or more pistons in the same manner as shown herein for piston 50. The collar 98 having multiple projections 100 at different clock positions around the shaft 94 respectively connected to parallel pistons, including piston 50.

Outlet check valve 34 is disposed within pump body 48 downstream of pump chamber 66. Cage 106 is disposed within a portion of pump bore 104. Valve member 108 is retained within pump body 48 by cage 106. Valve member 108 can be a ball, among other options. Valve member 108 seals with the seat 112 with an annular interface therebetween. Seat 112 is formed by an annular outlet from inner cylinder 68. In the example shown, seat 112 is formed from the polymer material of the pump body 48. In particular, the inner cylinder 68 has a circular outlet lip with which the valve member 108 interfaces and seals with on the suction stroke. During the pressure stroke, valve member 108 lifts off of seat 112 to open a flowpath through outlet check valve 34.

During electrostatic spraying, electrostatic module 40 is powered and outputs the electrostatic charge via charge lead 78. Electrostatic energy is delivered to the drive 30 via charge lead 78 at fastener 118. The electrostatic energy flows through the cap 88, rear bearing 90, shaft 94, collar 98, projection 100, and to piston 50. It is understood that, in some examples, other flow paths can be taken by the electrostatic energy, depending on the configuration of sprayer 10. In some examples, charge lead 78 can extend to motor 28 to be connected to motor 28. The electrostatic energy flows to gear 96 through pinion 86. The electrostatic energy flows through gear 96, shaft 94, collar 98, projection 100, and to piston 50. In some examples, other flowpaths can be formed by different drives that may have different mechanisms for converting rotational to linear motion. As demonstrated, however, electrostatic energy can still flow through contacting parts from the electrostatic module 40 to the piston 50. In some examples, the electrically conductive material of the piston 50 is the only component of the fluid sprayer 10 configured to provide electrostatic charge to the fluid. In some examples, the fluid receives electrostatic charge only from the electrically conductive material of the piston 50.

Figure 3A:
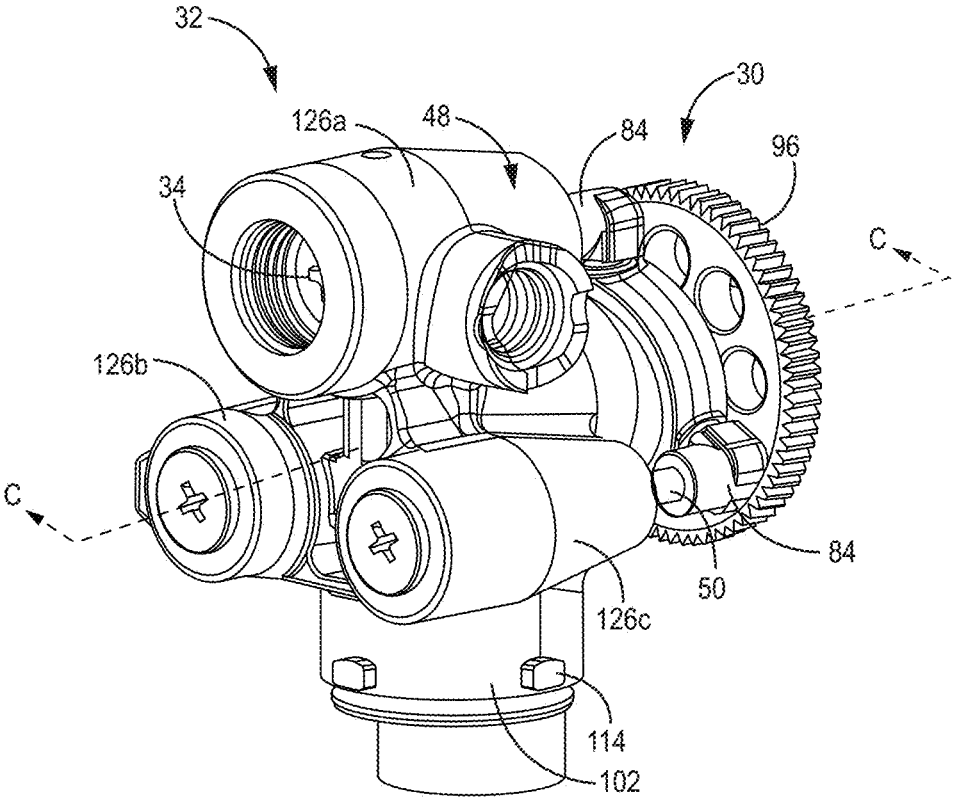
FIG. 3A is a front isometric view of a pump and drive.
Figure 3B:
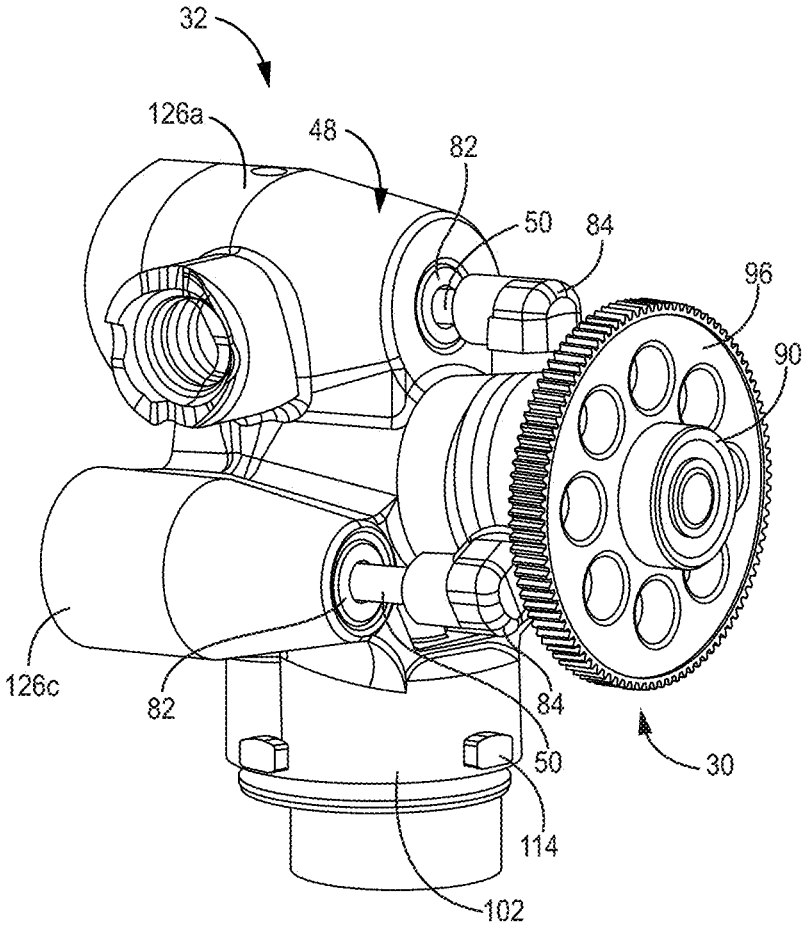
FIG. 3B is a rear isometric view of the pump and drive shown in FIG. 3A.
Figure 3C:
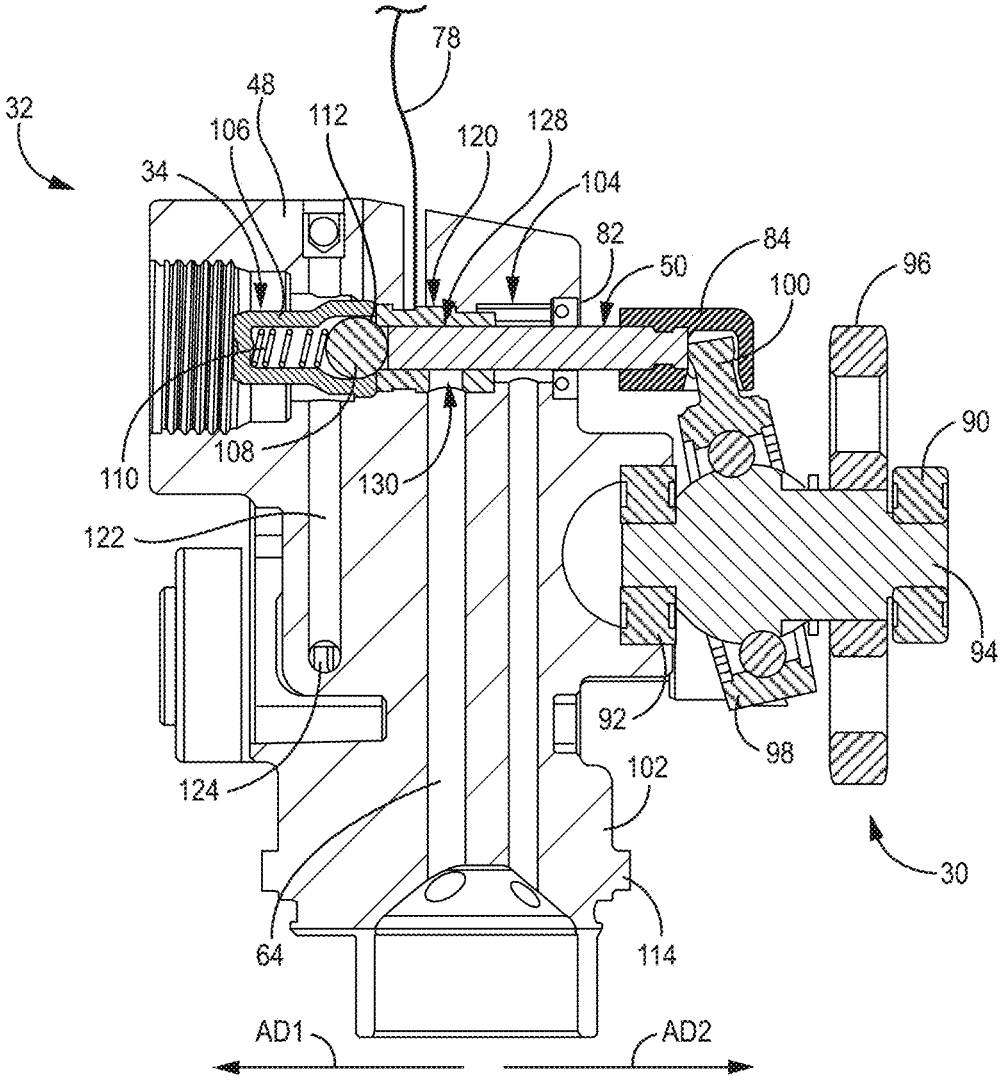
FIG. 3C is a cross-sectional view taken along line C-C in FIG. 3A.

FIG. 3A is a first isometric view of pump 32 and drive 30. FIG. 3B is a second isometric view of pump 32 and drive 30. FIG. 3C is a cross-sectional view taken along line 3-3 in FIG. 3A. Pump 32 includes pump body 48, piston 50, and pump cylinder 120. Fluid intake 64, pump bore 104, radial bores 122 (only one of which is shown), and flow intersection 124 of pump body 48 are shown. Pump body 48 further includes pump neck 102, cylinder housings 126*a*-126*c*. Pump cylinder 120 includes axial bore 128 and inlet bore 130.

Pump 32 is substantially similar to pump 32 (FIGS. 1B-2B), except pump 32 includes pump cylinder 120 disposed within pump body 48. Cylinder housings 126*a*-126*c* are formed by pump body 48 and surround the piston bores 66 that pistons 50 reciprocate within. The pump cylinder 120 shown is disposed within cylinder housing 126*a* in pump bore 104. Pump cylinder 120 can be embedded within pump body 48. In some examples, pump body 48 can be molded around pump cylinder 120. Pump cylinder 120 at least partially defines pump chamber 66. Pump cylinder 120 defines the wall of pump chamber 66. Pump cylinder 120 can define the seat 112 for check valve 34. Seat 112 is formed from the material of the pump cylinder 120. In particular, the pump cylinder 120 has a circular outlet lip with which the valve member 108 interfaces and seals with on the suction stroke. Pump cylinder 120 can be formed from a conductive material. Pump cylinder 120 can be metal. Pump cylinder 120 can be formed from tungsten carbide, brass, titanium, or stainless steel, among other electrically conductive metals.

Pistons 50 extend from drive 30 into cylinder housings 126*a*-126*c*. In the example shown, pump 32 includes three pistons 50. It is understood that some examples of pump 32 can include other numbers of pistons 50, such as one piston 50. The axes of reciprocation of each of the multiple pistons 50 can be disposed parallel one another. The axis of reciprocation of the piston 50 in cylinder housing 126*b* can be offset from and parallel with the axis of reciprocation of the piston 50 in cylinder housing 126*a*. The axis of reciprocation of the piston 50 in cylinder housing 126*c* can be offset from and parallel with the axes of reciprocation of the pistons 50 in cylinder housings 126*a*, 126*b*. The axes of reciprocation of the pistons 50 in cylinder housings 126*b*, 126*c* can be offset from and parallel with the spray axis S-S. The axis of reciprocation of piston 50 in cylinder housing 126*a* can be coaxial with spray axis S-S.

Piston 50 extends from drive 30 and into axial bore 128 through throat seal 82. Piston 50 extends into and reciprocates within pump cylinder 120 to generate pressure in pump chamber 66. Pump chamber 66 is at least partially defined by axial bore 128. In some examples, pump 32 can place the fluid under pressure up to about 20.7 MPa (about 3000 psi). In some examples, pump 32 can place the fluid under pressure up to about 34.5 MPa (about 5000 psi). In some examples, pump 32 can place the fluid under pressure between about 3.45 MPa (about 500 psi) and about 34.5 MPa (about 5,000 psi). Piston 50 is tightly toleranced to pump cylinder 120 such that a dynamic seal is formed therebetween and fluid is prevented from leaking upstream around the interface between piston 50 and pump cylinder 120. Piston 50 is driven in a linear, reciprocating manner by drive 30 to draw fluid into pump cylinder 120 through fluid intake 64 and inlet bore 130.

A portion of charge lead 78 is shown. Charge lead 78 can extend to pump cylinder 120 to provide electrostatic energy directly to pump cylinder 120. In the example shown, charge lead 78 extends through a portion of pump body 48 to contact pump cylinder 120. Pump cylinder 120 is thereby connected to electrostatic module 40 (FIG. 1B) such that the electrostatic charge is transferred to the fluid through pump cylinder 120. As such, pump cylinder 120 can serve multiple functions, including providing the electrostatic charge to the fluid, sealing with piston 50, at least partially defining pump chamber 66 to build the fluid pressure (e.g., up to about 34.5 MPa (about 5000 psi), and providing a seat 112 for outlet check valve 34.

Figure 4:
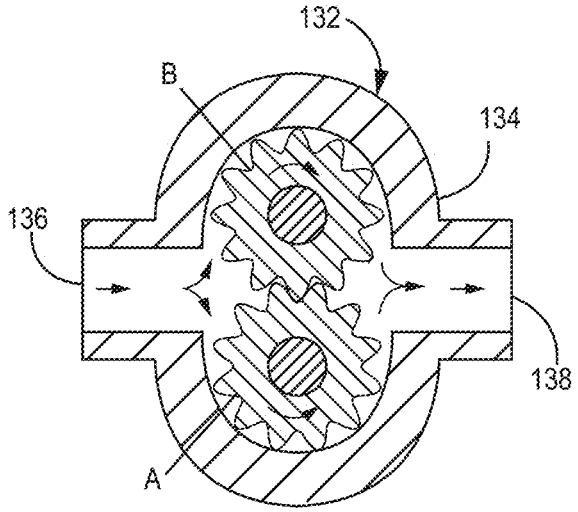
FIG. 4 is a cross-sectional view of a pump.

FIG. 4 is a cross-sectional view of gear pump 132. While gear pump 132 can have a single gear, the illustrated gear pump 132 has first gear A and second gear B. Gear A and gear B are located within a housing 134. Gear A and gear B interface to seal and force the flow of fluid from inlet 136 to outlet 138 via pockets in the gearing that advance from the inlet 136 toward the outlet 138. Gear A and gear B are fluid displacement members of gear pump 132. The fluid can be driven downstream to be sprayed. A shaft connected to either gear A or gear B can extend out of the housing 134. The end of the shaft can include gearing that interfaces with a pinion, such as pinion 86 of the motor 28 (in a plane not shown), such that the motor 28 rotates gear A and gear B to pump the fluid. One or both of gear A and gear B can be metal and electrically connected with the electrostatic module 40. Thus, it can be gear A or gear B that electrostatically charges the fluid being pumped. Similar to the piston examples shown in FIGS. 1B-3, it is within the pumping chamber that electrostatic charge is delivered to the fluid being pumped.

Figure 5:
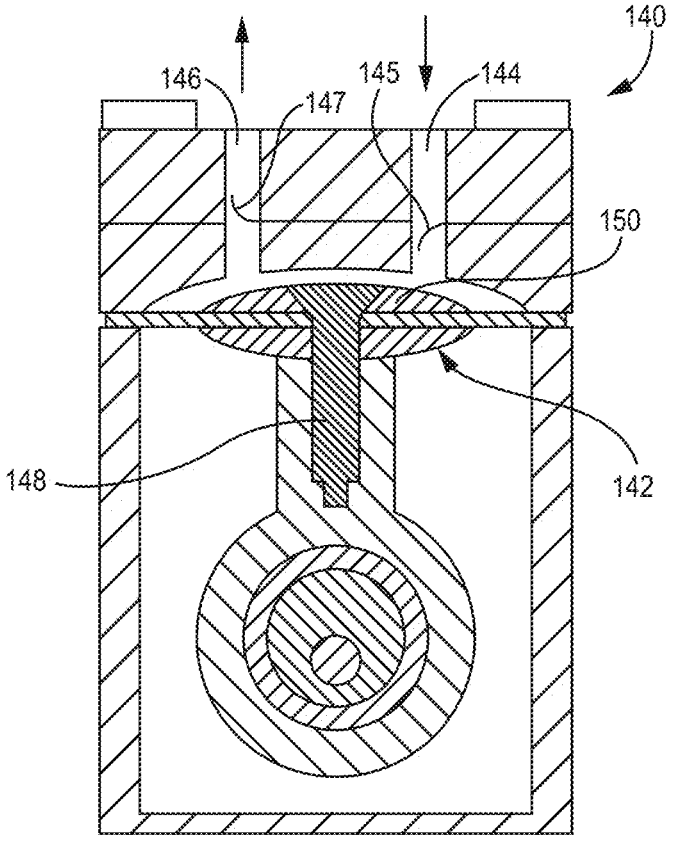
FIG. 5 is a cross-sectional view of a pump.

FIG. 5 is a cross-sectional view of diaphragm pump 140. The center of the diaphragm 142 is mechanically reciprocated linearly similar to how the piston of the earlier embodiment is linearly reciprocated. Reciprocating motion of the diaphragm 142 expands and collapses the pumping chamber 66 to pull in liquid from the inlet 144 through a one-way inlet valve 145 and force liquid out the outlet 146 and through a one-way outlet valve 147 to be sprayed. The diaphragm 142, disc 150, and stud 148 form a fluid displacement member of diaphragm pump 140. The diaphragm 142 itself is typically flexible polymer, including various types of rubber, and is insulative. One or both of disc screw stud 148 (if metal) or metal clamping disc 150 can be electrically connected to the electrostatic module 40 to deliver electrostatic energy within the pumping chamber 66 to the fluid being pumped.

Figure 6:
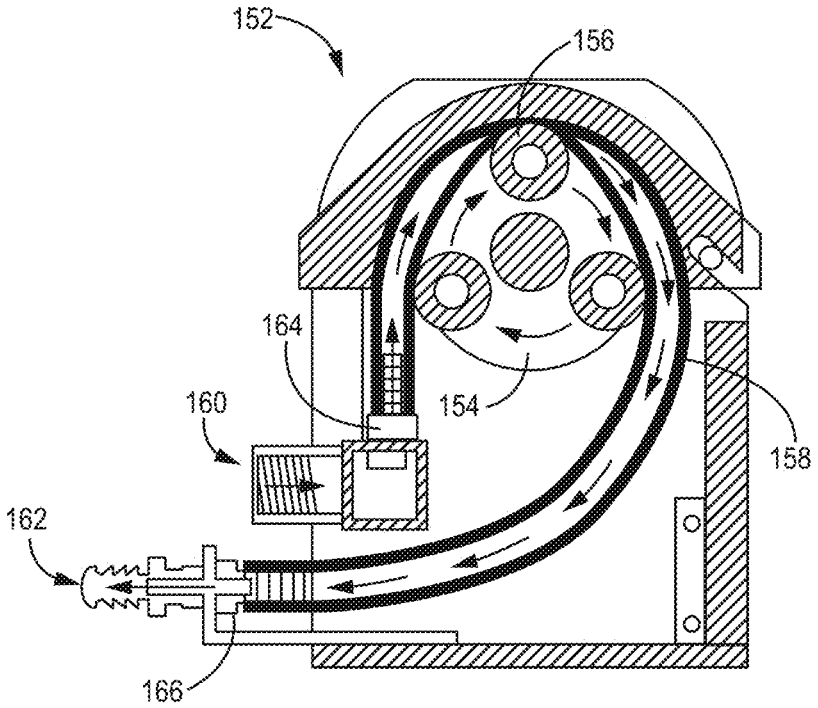
FIG. 6 is a cross-sectional view of a pump.

FIG. 6 is a cross-sectional view of peristaltic pump 152. The rotor 154 can be turned by the pinion 86. A plurality of rollers 156 on the rotor 154 engage a hose 158, pinching the hose 158 along moving segments to move fluid from the inlet 160 to the outlet 162. Rollers 156 and rotor 154 form a fluid displacement member of peristaltic pump 152. Fluid leaving the outlet 162 can be sprayed. The inlet fitting 164 and/or outlet fitting 166 of the hose 158, or another part of the fluid circuit, can be metal and connected with the electrostatic module 40 to deliver electrostatic energy to the fluid being pumped.

Figure 7:
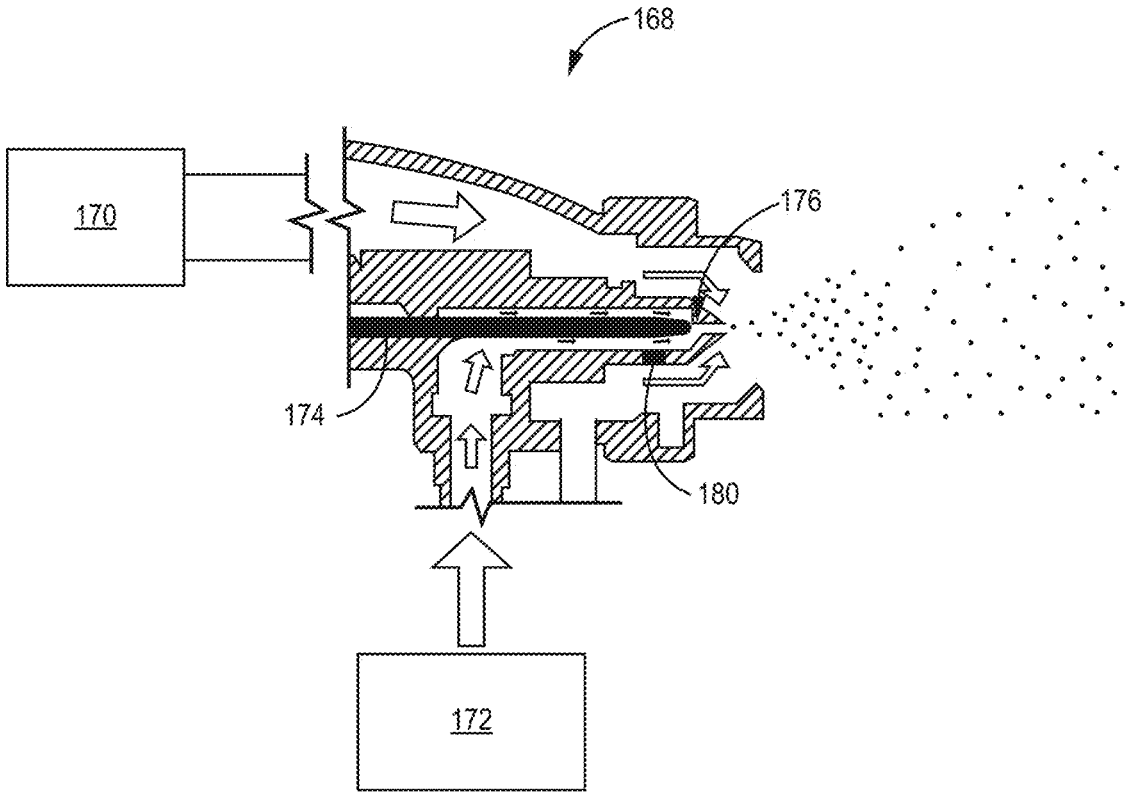
FIG. 7 is a cross-sectional view of a portion of a spray gun.

FIG. 7 is a schematic cross-sectional view of an high-volume, low-pressure (HVLP) system 168. A turbine 170 is spun to generate a high volume of air flow at relatively low pressure, typically below 20 psi. The flow of air can be used to atomize the fluid for spraying. As shown, the fluid is pulled from the reservoir 172 (by gravity, any type of pump, or via Bernoulli effect from the airflow). Retracting the needle 174 opens the valve 176 for the fluid to enter airflow chamber 178. In airflow chamber 178, the fluid is blasted by the flow of air to atomize the fluid and can be electrified by the electrostatic module 40. Electrode 180 can be placed along the fluid pathway upstream of the chamber 178, or within the chamber 178, to electrostatically charge the fluid. In some examples, the electrostatic module 40 can be electrically connected to the needle 174 to charge the fluid.

While various embodiments shown herein have shown the sprayer 10 (FIGS. 1A-2B) as a stand-alone handheld device, part of the sprayer 10 can instead be worn. For example, the reservoir might be part of the backpack with a hose extending to the body of the sprayer to feed the fluid into the pump. Alternatively, the pump can be part of the backpack. In either case, the fluid can be charged in the backpack or the handheld unit using the same charging options discussed herein. It is understood that, while the embodiments herein have been discussed in connection spraying a sanitary fluid, any sprayer referenced herein can spray fluid, not just sanitary fluid.

In some examples, the electrostatic module 40 is separate from the sprayer. In this case, electrostatic module 40 is a standalone device that can be placed inside of the reservoir to electrostatically charge the fluid to the reservoir. For example, the reservoir could be a bucket and the sprayer can suck the fluid from the bucket via a hose. The electrostatic module 40 within the bucket or other reservoir can then be charged to charge the fluid before it enters the pump or even the sprayer. This can save costs on not having to integrate the electrostatic module 40 with the sprayer, and electrostatic module 40 can be used with multiple different types of sprayers and providing a charge to multiple sprayers simultaneously if they are pulling the fluid from the common reservoir. The electrostatic module 40 can include a sealed housing with all electrical components inside and one or more electrodes exposed on the exterior of the housing.

In some embodiments, the electrostatic module 40 can be remote from the sprayer, but the electrostatic charge is still delivered to the fluid within the sprayer, such as by any technique described herein. For example, the electrostatic module 40 can be exterior of the housing of the sprayer and can include a cord which plugs into a port on the exterior of the sprayer. Putting the cord into the port can establish electrical connection between the electrostatic module 40 and a lead that extends to one or more electrically conductive components in contact with the fluid to electrostatically charge the fluid. The electrostatic module 40 can be disconnected from the sprayer to be used with a different sprayer and/or the sprayer can be used with a different electrostatic module 40. In this way, the electrostatic module 40 does not have to be integrated with the sprayer and the sprayer can be sold separately from the electrostatic module 40, depending on the preferences of the user. The electrostatic module 40 can in some examples be worn on the body of the user, such as on the back or belt, or can be carried in a separate hand. Electrostatic module 40 can be hung off of the sprayer when in use. Electrostatic module 40 in this case can charge the spray tip (nozzle), the piston, or any other component mentioned herein for delivering the electrostatic charge to the fluid.

A fluid sprayer according to the disclosure can include a pump having at least one fluid displacement member configured to place fluid under pressure and an electrostatic module that supplies electrical energy to a conductive component that is exposed to the fluid within the pump to transfer electrostatic charge to the fluid. The at least one fluid displacement member can be the conductive component. The at least one fluid displacement member can be configured to reciprocate to pump the fluid. The at least one fluid displacement member can be a piston, a diaphragm, or a gear, among other options. The pump can be a piston pump, a diaphragm pump, a gear pump, a peristaltic pump, among other options.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A portable fluid sprayer comprising:
- a sprayer body;
- a handle extending from the sprayer body;
- a nozzle configured to emit a fluid spray and supported by the sprayer body;
- a trigger configured to control spraying from the nozzle;
- a reservoir configured to hold spray fluid;
- a pump supported by the sprayer body and configured to pump spray fluid from the reservoir to the nozzle, the pump comprising:
  - a pump body having a fluid inlet and a fluid outlet;
  - a fluid displacement member at least partially disposed within the pump body and configured to move to draw the spray fluid into the pump through the fluid inlet, pressurize the spray fluid, and drive the spray fluid to the fluid outlet under pressure for spraying through the nozzle, the fluid displacement member comprising an electrically conductive material that moves during pumping; and
- an electrostatic generator electrically connected to the electrically conductive material of the fluid displacement member so that the fluid displacement member electrostatically charges the fluid as the fluid displacement member moves to pump the fluid to the nozzle.

2. The fluid sprayer of claim 1, further comprising:
- a drive mechanically connected to the fluid displacement member to displace the fluid displacement member and cause pumping of the fluid;
- wherein the electrostatic generator is electrically connected to the fluid displacement member by an electric pathway through the drive.

3. The fluid sprayer of claim 2, further comprising:
- an electric motor operatively connected to the drive to cause displacement of the fluid displacement member by the drive.

4. The fluid sprayer of claim 3, wherein the drive is configured to convert rotational motion output by the electric motor into linear reciprocating motion.

5. The fluid sprayer of claim 1, wherein the fluid displacement member comprises a piston configured to be linearly reciprocated.

6. The fluid sprayer of claim 5, wherein the piston is configured to cover an opening of an inlet bore into a pressure chamber at least partially defined by the electrically conductive material at the end of a pressure stroke, and is configured to uncover the opening at the end of a suction stroke.

7. The fluid sprayer of claim 1, wherein the nozzle is electrically isolated from the fluid displacement member except by the fluid.

8. The fluid sprayer of claim 7, further comprising:
- a rotatable spray tip that supports the nozzle.

9. The fluid sprayer of claim 1, wherein the spray fluid is not directly electrostatically charged within a reservoir of the fluid sprayer.

10. The fluid sprayer of claim 1, further comprising:
- a battery supported by the sprayer and electrically connected to the electrostatic generator to provide power to the electrostatic generator.

11. The fluid sprayer of claim 1, further comprising:

a grounding element removably connectable to the sprayer.

12. The fluid sprayer of claim 1, wherein the fluid receives electrostatic charge only from the electrically conductive material of the fluid displacement member.

13. A portable fluid sprayer comprising:

a sprayer body;

a nozzle supported by the sprayer body and configured to emit a fluid spray;

a trigger configured to control spraying from the nozzle;

a pump supported by the sprayer body and including a piston configured to reciprocate through a suction stroke to draw fluid into a pump chamber and a pressure stroke to pump spray fluid out of the pump chamber to the nozzle, wherein the piston comprises an electrically conductive material that moves during pumping; and an electrostatic generator electrically connected to the piston to provide an electrostatic charge to the piston such that the piston can provide electrostatic energy to the spray fluid to charge the spray fluid;

wherein the fluid sprayer is operable to spray fluid from the nozzle both in a first state, during which the electrostatic generator provides the electrical energy to charge the spray fluid, and in a second state, during which the electrostatic generator does not charge the spray fluid.

14. The fluid sprayer of claim 13, further comprising:

a removable grounding element configured to be connected to the portable fluid sprayer to ground the portable fluid sprayer with the portable fluid sprayer in the first state.

15. The fluid sprayer of claim 13, further comprising:

a switch actuatable to control the electrostatic generator between an active state and an inactive state, the electrostatic generator configured to provide electrostatic energy to the piston in the active state and configured to not provide electrostatic energy to the piston in the inactive state.

16. A portable fluid sprayer comprising:

a sprayer body;

a nozzle configured to emit a fluid spray;

a trigger configured to control spraying from the nozzle;

a pump including a piston configured to reciprocate to pump spray fluid to the nozzle, wherein the piston comprises an electrically conductive material that moves during pumping;

a drive mechanically connected to the piston to reciprocate the piston and cause pumping of the spray fluid by the piston;

an electric motor supported by the sprayer body and operatively connected to the drive to cause reciprocation of the piston by the drive; and an electrostatic generator electrically connected to the piston to provide an electrostatic charge to the piston such that the piston can provide electrostatic energy to the spray fluid to charge the spray fluid.

17. The portable fluid sprayer of claim 16, wherein the electrostatic generator is electrically connected to the electric motor such that the electrostatic charge is provided to the piston through the electric motor.

18. The portable fluid sprayer of claim 16, further comprising:

a cylinder disposed within the sprayer body, wherein the piston extends into and reciprocates within the cylinder.

19. The portable fluid sprayer of claim 16, further comprising:

a check valve disposed downstream of the piston and upstream of the nozzle.

20. The portable fluid sprayer of claim 16, further comprising:

a battery configured to provide electrical power to the electrostatic generator and to the electric motor.

* * * * *